US009051083B1

(12) United States Patent
Davis et al.

(10) Patent No.: US 9,051,083 B1
(45) Date of Patent: Jun. 9, 2015

(54) ADJUSTABLE STORAGE BUCKET DEVICE

(71) Applicants: Dianne R. Davis, Miami Gardens, FL (US); Reina D. Webb, Miami Gardens, FL (US)

(72) Inventors: Dianne R. Davis, Miami Gardens, FL (US); Reina D. Webb, Miami Gardens, FL (US)

( * ) Notice: Subject to any disclaimer, the term of this patent is extended or adjusted under 35 U.S.C. 154(b) by 0 days.

(21) Appl. No.: 14/096,546

(22) Filed: Dec. 4, 2013

(51) Int. Cl.
*B65D 25/06* (2006.01)

(52) U.S. Cl.
CPC ..... *B65D 25/06* (2013.01)

(58) Field of Classification Search
CPC ..... B60K 15/03177; B60K 2015/03493; B65D 25/06
USPC ..... 220/254.3, 529, 532, 533, 534, 544, 220/552
See application file for complete search history.

(56) References Cited

U.S. PATENT DOCUMENTS 3,656,650 A * 4/1972 Frater ..... 220/533
3,680,177 A * 8/1972 Ginsberg ..... 220/533
4,602,715 A * 7/1986 Sarver et al. ..... 206/523
5,261,556 A 11/1993 Gatto
D370,346 S 6/1996 Zimmerman
5,996,749 A 12/1999 Hillsberg et al.
6,959,811 B1 * 11/2005 Hoover ..... 206/315.11
7,234,630 B2 6/2007 Wang
2006/0011686 A1 1/2006 Latham
2006/0124643 A1 * 6/2006 Markert et al. ..... 220/254.3
2006/0151585 A1 7/2006 Misjak

OTHER PUBLICATIONS

Source: www. overstock.com Product Name: Artbin Super Semi-Satchel Plastic Storage Container.

* cited by examiner

*Primary Examiner* — Fenn Mathew
*Assistant Examiner* — Elizabeth Volz

(57) ABSTRACT

An adjustable storage bucket device permits customizing storage space to facilitate storing multiple types of items in a single container. The device includes a container having a bottom wall and a perimeter wall coupled to and extending upwardly from a perimeter edge of the bottom wall, a top edge of the perimeter wall defining an opening into an interior space of the container. A plurality of vertical rails is coupled to an interior face of the perimeter wall wherein the vertical rails are positioned in the interior space. A lateral panel is selectively positionable in the interior space. Opposite sides of the lateral panel are positioned between a selectable opposed pair of the vertical rails wherein the lateral panel is supported in an upright position in the interior space.

7 Claims, 6 Drawing Sheets

ADJUSTABLE STORAGE BUCKET DEVICE

BACKGROUND OF THE DISCLOSURE

Field of the Disclosure

The disclosure relates to bucket devices and more particularly pertains to a new bucket device for customizing storage space to facilitate storing multiple types of items in a single container.

SUMMARY OF THE DISCLOSURE

An embodiment of the disclosure meets the needs presented above by generally comprising a container having a bottom wall and a perimeter wall coupled to and extending upwardly from a perimeter edge of the bottom wall, a top edge of the perimeter wall defining an opening into an interior space of the container. A plurality of vertical rails is coupled to an interior face of the perimeter wall wherein the vertical rails are positioned in the interior space. A lateral panel is selectively positionable in the interior space. Opposite sides of the lateral panel are positioned between a selectable opposed pair of the vertical rails wherein the lateral panel is supported in an upright position in the interior space.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
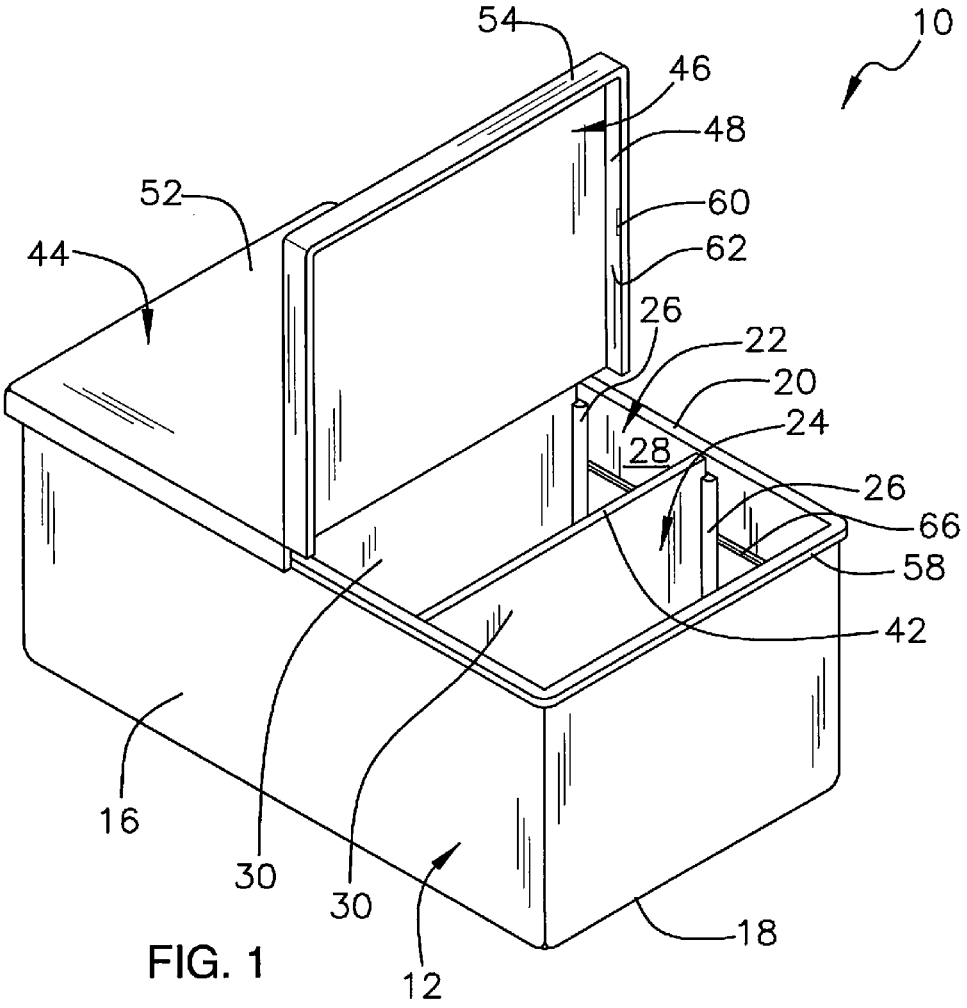
FIG. 1 is a top front side perspective view of a adjustable storage bucket device according to an embodiment of the disclosure.
Figure 2:
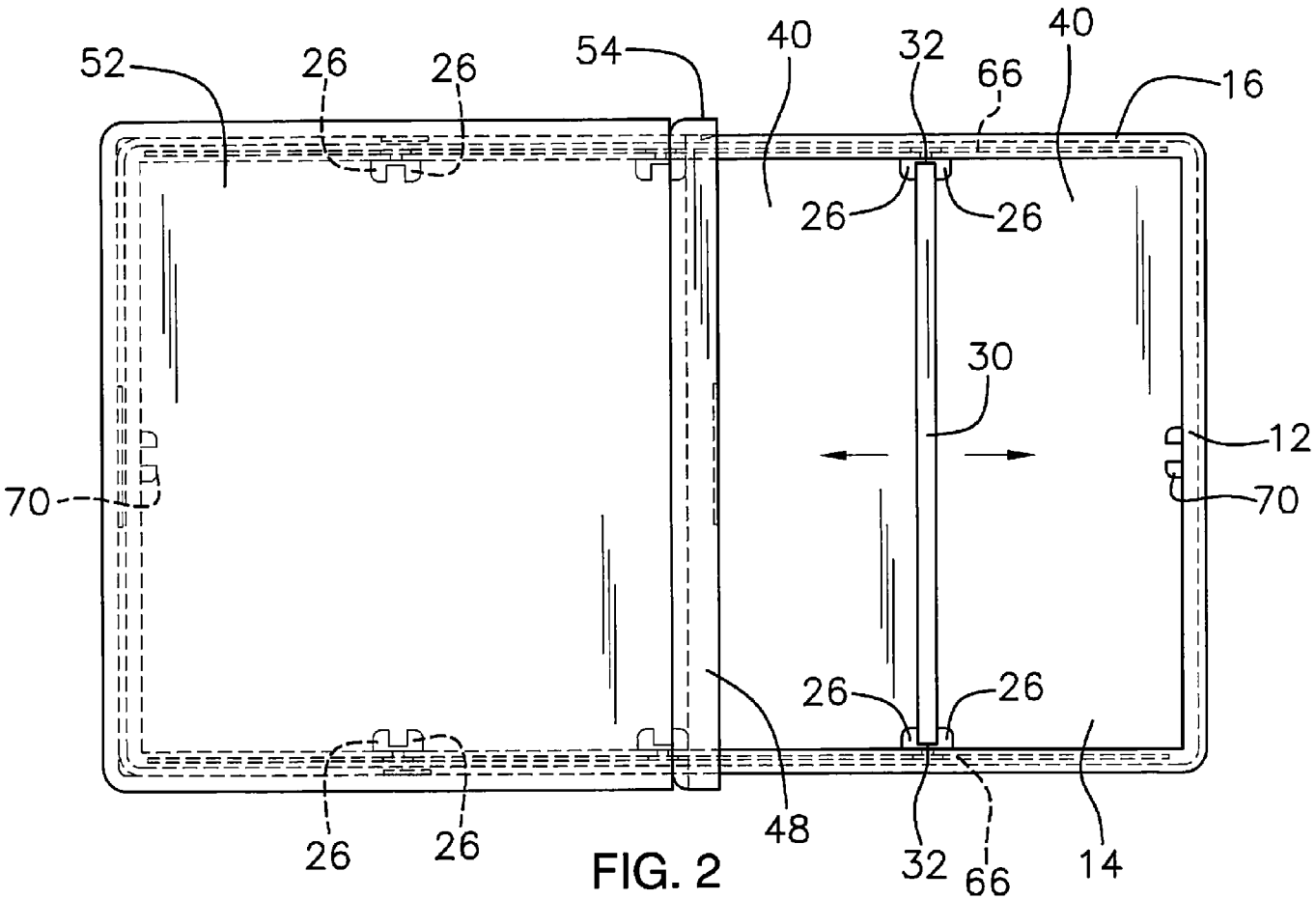
FIG. 2 is a top view of an embodiment of the disclosure.
Figure 3:
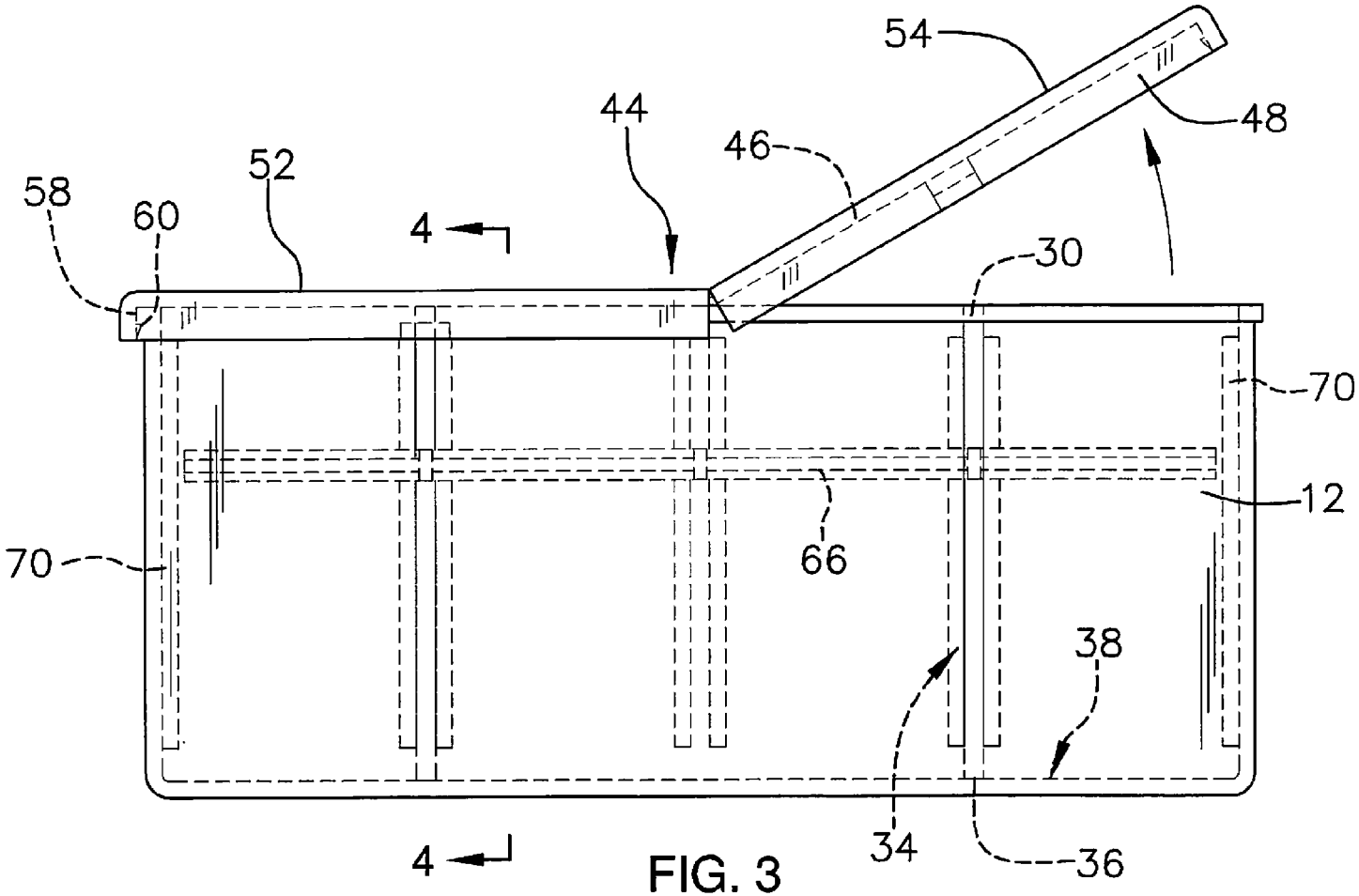
FIG. 3 is a front view of an embodiment of the disclosure.
Figure 4:
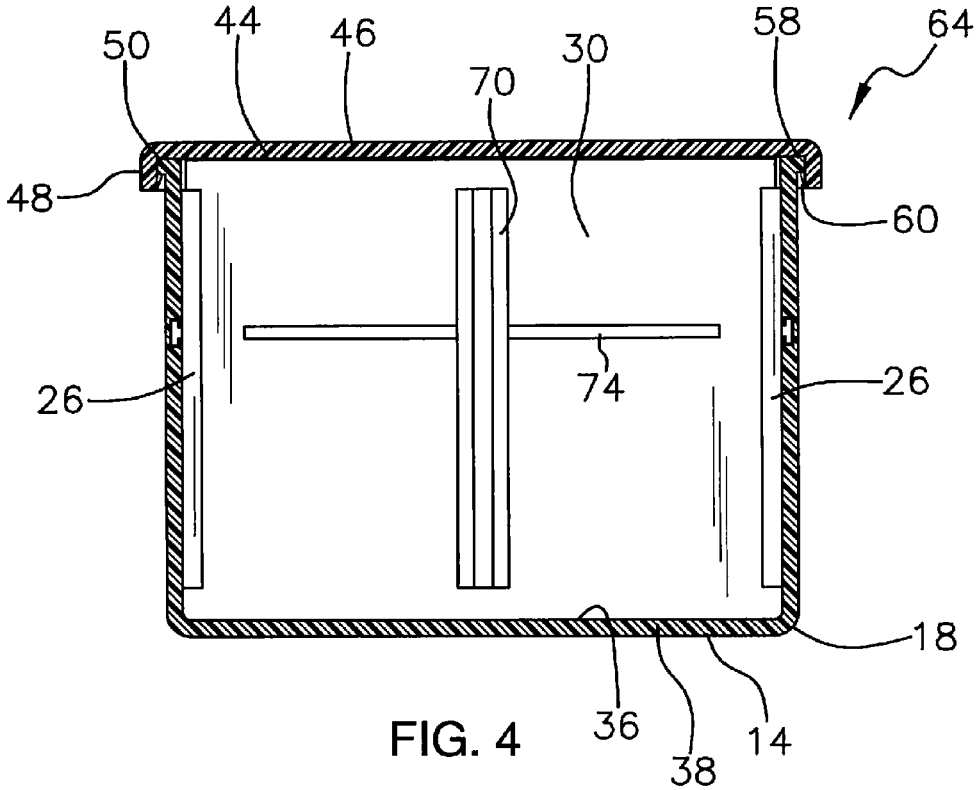
FIG. 4 is a cross-sectional view of an embodiment of the disclosure taken along line 4-4 of FIG. 3.
Figure 5:
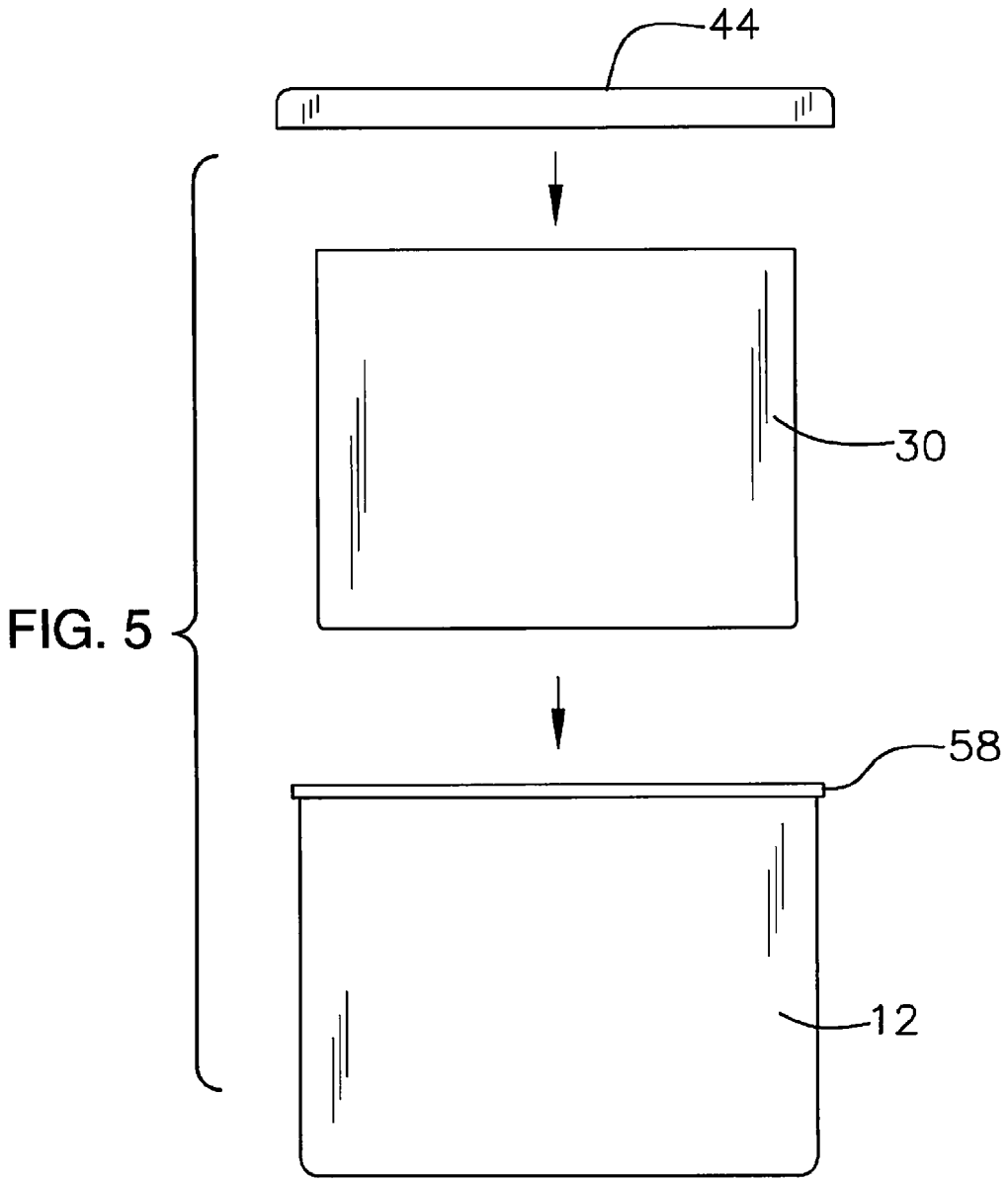
FIG. 5 is a partially exploded side view of an embodiment of the disclosure.

With reference now to the drawings, and in particular to FIGS. 1 through 6 thereof, a new bucket device embodying the principles and concepts of an embodiment of the disclosure and generally designated by the reference numeral 10 will be described.

As best illustrated in FIGS. 1 through 6, the adjustable storage bucket device 10 generally comprises a container 12 having a bottom wall 14 and a perimeter wall 16 coupled to and extending upwardly from a perimeter edge 18 of the bottom wall 14. A top edge 20 of the perimeter wall 16 defines an opening 22 into an interior space 24 of the container 12. A plurality of vertical rails 26 is coupled to an interior face 28 of the perimeter wall 16 wherein the vertical rails 26 are positioned in the interior space 24. The vertical rails 26 may be transversely oriented relative to the bottom wall 14. A lateral panel 30 is selectively positionable in the interior space 24. Opposite sides 32 of the lateral panel 30 are positioned between a selectable opposed pair of the vertical rails 26 wherein the lateral panel 30 is supported in an upright position 34 in the interior space 24. The opposite sides 32 of the lateral panel 30 may abut the interior face 28 of the perimeter wall 16 when the lateral panel 30 is inserted into the interior space 24 between the selectable opposed pair of the vertical rails 26. A bottom edge 36 of the lateral panel 30 may further abut a top surface 38 of the bottom wall 14 when the lateral panel 30 is fully inserted into the interior space 24 between the selectable opposed pair of the vertical rails 26. Thus, the lateral panel 30 effectively divides the interior space 24 in separate compartments 40. A top edge 42 of the lateral panel 30 may be coplanar with the top edge 20 of the perimeter wall 16 when the lateral panel 30 is fully inserted into the interior space 24 between the selectable opposed pair of the vertical rails 26.

A lid 44 is selectively couplable to the container 12 wherein the lid 44 covers the opening 22 into the container 12. The lid 44 may comprise a medial section 46 and a peripheral wall 48 extending downwardly from a peripheral edge 50 of the medial section 46. The lid 44 has a first section 52 pivotably coupled to a second section 54 wherein a selectable one of the first section 52 and the second section 54 is pivotable away from the top edge 20 of the perimeter wall 16. A lip 58 may extend outwardly from the top edge 20 of the perimeter wall 16 of the container 12. A plurality of tabs 60 may be coupled to and extend from an inwardly directed face 62 of the peripheral wall 48. Each of the tabs 60 engages the lip 58 wherein the lid 44 is secured in a closed position 64 covering the opening 22 into the container 12. The lid 44 and container 12 may be insulated for storage or items requiring cooling.

The lateral panel 30 may be one of a plurality of similarly constructed lateral panels 30. Each lateral panel 30 having the opposite sides 32 selectively positionable between respective opposed pairs of the vertical rails 26 wherein each lateral panel 30 is supported in the upright position 34 in the interior space 24 to further divide the interior space 24 into a desired number of smaller compartments 40. Each lateral panel 30 may also be constructed of a material to insulate between adjacent compartments 40.

A pair of horizontal rails 66 may extend into and along the interior face 28 of the perimeter wall 16 on a longitudinal side 68 of the perimeter wall 16. Each of the vertical rails 26 is slidably coupled to an associated one of the horizontal rails 66 allowing the vertical rails 26 to be positioned at a selectable position within the interior space 24.

Figure 6:
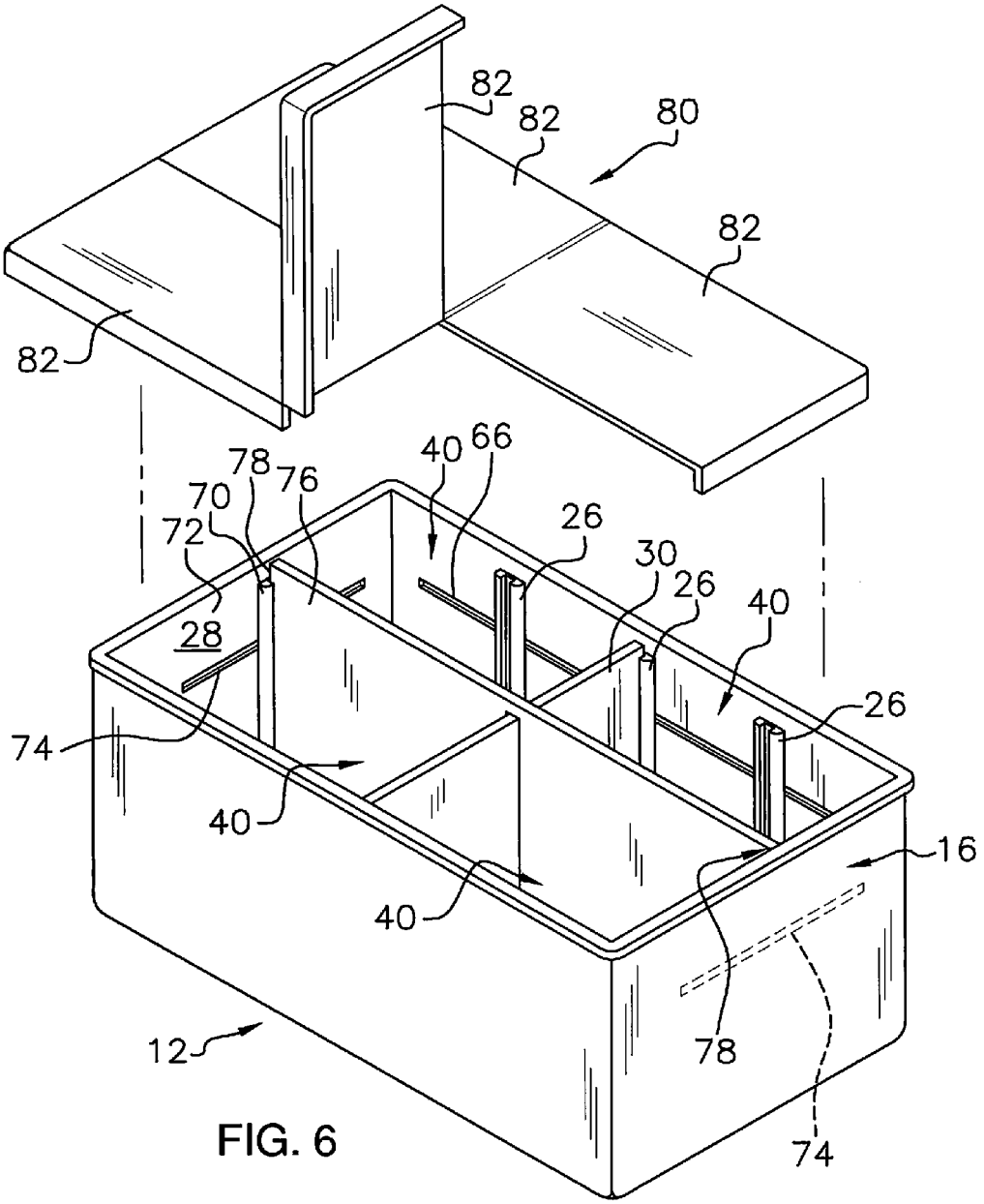
FIG. 6 is a partially exploded top front side perspective view of an embodiment of the disclosure.

A pair of end rails 70 may also be provided. Each end rail 70 is coupled to the interior face 28 of the perimeter wall 16 on an associated end side 72 of the perimeter wall 16. Each end rail 70 may also be slidably coupled to a horizontal end groove 74 in the same manner as the vertical rails 26 are coupled to the horizontal rails 66 to permit selective positioning of the end rails 70. A longitudinal panel 76 is selectively positionable in the interior space 24. Opposite sides 78 of the longitudinal panel 76 are positioned between the end rails 70 wherein the longitudinal panel 76 is supported in an upright position in the interior space 24. Each of the longitudinal panel 76 and at least one of the lateral panels 30 may be slotted in a conventional manner for interlocking panels wherein the longitudinal panel 76 and the one of the lateral panels 30 are selectively slidably engageable and positionable to be simultaneously positioned within the interior space 24 defining separate compartments 40. As shown in FIG. 6, an alternative lid 80 may be selectively couplable to the container 12 wherein the lid 80 covers the opening 22 into the container 12. The lid 80 has a plurality of pivotable sections 82 defining four corners of the lid 80. These pivotable sections 82 may be joined together at a central point by conventional methods. Each pivotable section 82 aligns with an associated separate compartment 40 within the interior space 24 providing access to each separate compartment 40 independently. Other than the four pivotable sections 82, the lid 80 may be similarly structured to lid 44.

In use, the interior space 24 of the container 12 is divided into a desired number of compartments 40 by selective insertion of lateral panels 30 between the vertical rails 26. Thus, food items may be kept separately from non food items or items generally may be otherwise organized and distributed into the compartments within the interior space 24 as desired. Insertion of one of the lateral panels 30 may also be used to reduce the used interior space 24 to reduce the amount of cooling material, such as ice, required to efficiently store small amounts.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. An adjustable storage bucket device comprising:

a container having a bottom wall and a perimeter wall coupled to and extending upwardly from a perimeter edge of said bottom wall, a top edge of said perimeter wall defining an opening into an interior space of said container;

a plurality of vertical rails coupled to an interior face of said perimeter wall wherein said vertical rails are positioned in said interior space;

a lateral panel, said lateral panel being selectively positionable in said interior space, opposite sides of said lateral panel being positioned between a selectable opposed pair of said vertical rails wherein said lateral panel is supported in an upright position in said interior space;

a pair of end rails, each end rail being coupled to said interior face of said perimeter wall on an associated end side of said perimeter wall; and a longitudinal panel, said longitudinal panel being selectively positionable in said interior space, opposite sides of said longitudinal panel being positioned between said end rails wherein said longitudinal panel is supported in an upright position in said interior space, each of said longitudinal panel and said lateral panel being slotted wherein said longitudinal panel and said lateral panel are slidably engageable and positionable to be simultaneously positioned within said interior space defining a plurality of separate compartments;

a lid selectively couplable to said container wherein said lid covers said opening into said container, said lid having a plurality of pivotable sections defining four corners of the lid, said pivotable sections being joined together at a central point, each said pivotable section aligning with an associated separate compartment within said interior space providing access to each separate compartment independently; and a pair of horizontal rails, each horizontal rail extending into and along said interior face of said perimeter wall on a longitudinal side of said perimeter wall, each of said vertical rails being slidably coupled to an associated one of said horizontal rails.

2. The device of claim 1, further comprising said opposite sides of said lateral panel abutting said interior face of said perimeter wall when said lateral panel is inserted into said interior space between said selectable opposed pair of said vertical rails.

3. The device of claim 1, further comprising:

a lip extending outwardly from said top edge of said perimeter wall of said container;

said lid comprising a medial section and a peripheral wall extending downwardly from a peripheral edge of said medial section; and a plurality of tabs coupled to and extending from an inwardly directed face of said peripheral wall, each of said tabs engaging said lip wherein said lid is secured in a closed position covering said opening into said container.

4. The device of claim 1, further comprising said lateral panel being one of a plurality of lateral panels, each lateral panel having said opposite sides selectively positionable between respective opposed pairs of said vertical rails wherein each lateral panel is supported in an upright position in said interior space.

5. The device of claim 1, further comprising a bottom edge of said lateral panel abutting a top surface of said bottom wall when said lateral panel is fully inserted into said interior space between said selectable opposed pair of said vertical rails.

6. The device of claim 5, further comprising a top edge of said lateral panel being coplanar with said top edge of said perimeter wall when said lateral panel is fully inserted into said interior space between said selectable opposed pair of said vertical rails.

7. An adjustable storage bucket device comprising:

a container having a bottom wall and a perimeter wall coupled to and extending upwardly from a perimeter edge of said bottom wall, a top edge of said perimeter wall defining an opening into an interior space of said container;

a plurality of vertical rails coupled to an interior face of said perimeter wall wherein said vertical rails are positioned in said interior space;

a lateral panel, said lateral panel being selectively positionable in said interior space, opposite sides of said lateral panel being positioned between a selectable opposed pair of said vertical rails wherein said lateral panel is supported in an upright position in said interior space, said opposite sides of said lateral panel abutting said interior face of said perimeter wall when said lateral panel is inserted into said interior space between said selectable opposed pair of said vertical rails;

a bottom edge of said lateral panel abutting a top surface of said bottom wall when said lateral panel is fully inserted into said interior space between said selectable opposed pair of said vertical rails;

a top edge of said lateral panel being coplanar with said top edge of said perimeter wall when said lateral panel is fully inserted into said interior space between said selectable opposed pair of said vertical rails;

a lid selectively couplable to said container wherein said lid covers said opening into said container, said lid comprising a medial section and a peripheral wall extending downwardly from a peripheral edge of said medial section, said lid having a first section pivotably coupled to a second section wherein a selectable one of said first section and said second section is pivotable away from said top edge of said perimeter wall;

a lip extending outwardly from said top edge of said perimeter wall of said container;

a plurality of tabs coupled to and extending from an inwardly directed face of said peripheral wall, each of said tabs engaging said lip wherein said lid is secured in a closed position covering said opening into said container;

wherein said lateral panel is one of a plurality of lateral panels, each lateral panel having said opposite sides selectively positionable between respective opposed pairs of said vertical rails wherein each lateral panel is supported in an upright position in said interior space;

a pair of horizontal rails, each horizontal rail extending into and along said interior face of said perimeter wall on a longitudinal side of said perimeter wall, each of said vertical rails being slidably coupled to an associated one of said horizontal rails;

a pair of end rails, each end rail being coupled to said interior face of said perimeter wall on an associated end side of said perimeter wall;

a longitudinal panel, said longitudinal panel being selectively positionable in said interior space, opposite sides of said longitudinal panel being positioned between said end rails wherein said longitudinal panel is supported in an upright position in said interior space; and each of said longitudinal panel and at least one of said lateral panels being slotted wherein said longitudinal panel and said one of said lateral panels are selectively slidably engageable and positionable to be simultaneously positioned within said interior space defining a plurality of separate compartments.

* * * * *